United States Patent [19]

Hill

[11] Patent Number: 5,012,567

[45] Date of Patent: May 7, 1991

[54] IMPACT TOOL

[76] Inventor: Steven F. Hill, P.O. Box 15, Mt. Vernon, Oreg. 97865

[21] Appl. No.: 398,947

[22] Filed: Aug. 28, 1989

[51] Int. Cl.[5] ..... B25B 27/00; B25D 17/06

[52] U.S. Cl. ..... 29/275; 173/128; 81/463

[58] Field of Search ..... 173/90, 91, 128; 29/275, 254; 81/8.1, 463

[56] References Cited

U.S. PATENT DOCUMENTS

| | | | |
|---|---|---|---|
| 1,496,134 | 6/1924 | Rumgay | 173/128 |
| 2,466,845 | 4/1949 | Ghee et al. | 81/8.1 |
| 2,629,985 | 3/1953 | McDowell | 29/275 |
| 2,833,120 | 5/1958 | Barrett et al. | 173/128 |
| 3,483,727 | 12/1969 | Giannetto | 29/275 |
| 4,624,323 | 11/1986 | Burrola | 173/128 |
| 4,720,904 | 1/1988 | Palla, Jr. | 173/90 |

*Primary Examiner*—Paul A. Bell
*Assistant Examiner*—Scott A. Smith
*Attorney, Agent, or Firm*—Paul F. Horton

[57] ABSTRACT

An impact tool having an elongated shank provided at a first end with a first impact member having a substantially perpendicular face plate laterally offset from the shank and provided at the second end with a second impact member, also having a substantially perpendicular face plate laterally offset from the shank in a direction opposite the first face plate; each of the face plates facing one another. The first impact member serves as a catch end of the tool to be placed in contact with the object to be impacted. The second impact member provides the strike plate, with the shank transmitting the force of the impact of a hammer or the like to the catch end to apply force to the object impacted in the same direction as the force initiated by the hammer. A handle may be provided for convenience. The catch end face plate may be substantially smaller in surface area than the surface area of the strike plate so that the catch end may be inserted into confined areas and so that greater force may be applied per surface area.

7 Claims, 1 Drawing Sheet

IMPACT TOOL

BACKGROUND OF THE INVENTION

1. Field of the Invention

This invention relates to impact tools in general, and, more particularly, to impact tools provided with a catch surface and a strike surface.

2. Description of the Prior Art

Often, to loosen, move, or remove a machine part, it is necessary to impact the part, as by a hammer. Unfortunately, the part is often inaccessible to the hammer because of its location relative to other machine parts or objects. In such a case, as for example the removal or loosening of bearings, sleeves, valves, coupled components, joints, and the like, another object or tool must be placed in contact with the part to receive a remotely struck blow. The tool used, then, becomes in effect an extension of the hammer. Such tools are typified by the nut rotating tool disclosed by R. Mefferd, U.S. Pat. No. 4,299,144; the calking device disclosed by P. R. Smith, U.S. Pat. No. 1,333,286; the cotter pin extractor invented by G. Shepard; the wheel weight device patented by G. Schmidt, U.S. Pat. No. 3,999,275; the combination tool of R. Reid, U.S. Pat. No. 3,710,407; and the muffler removing tool of T. Woyton, U.S. Pat. No. 2,860,408.

SUMMARY OF THE INVENTION

While all of these tools are useful for their selected purpose; none of the tools provide a shank provided at one end with a catch plate and the other end with a strike plate; the two plates having face plates facing one another, offset perpendicularly from the shank in opposing directions from one another, as does the present invention. A more complete description of the invention may be found in the appended claims.

It is therefore a primary object of the present invention to provide an impact tool having a catch plate for engaging an object to be moved and a strike plate for receiving a hammer blow, the faces of the plates facing one another so that a blow on the strike plate pulls the catch plate in the direction of the applied force.

It is also an object of the present invention to provide an impact tool having a catch end which is no wider than the shank for convenient placement in tight and otherwise inaccessible areas.

A further object of the present invention is to provide an impact tool having a planar catch surface which is smaller than the surface area of the strike plate to focus and place the impact force in a precise area.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
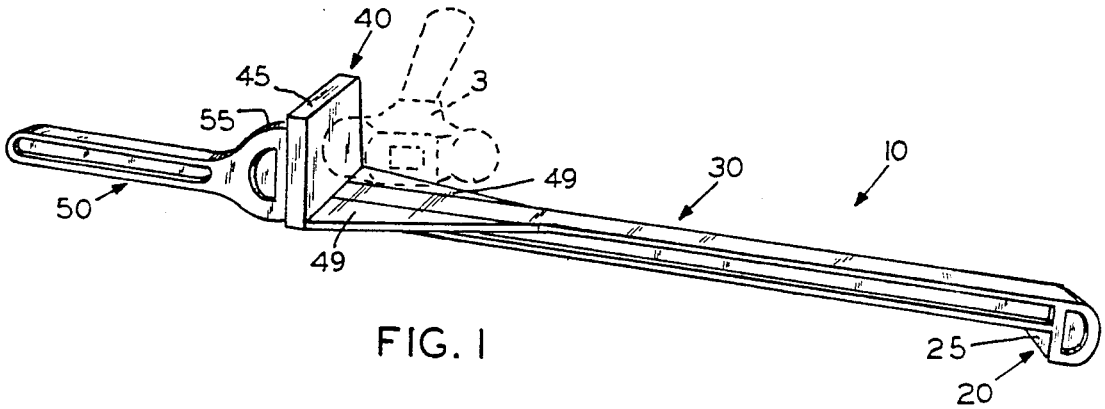
FIG. 1 is a perspective view of a preferred embodiment of the impact tool of the present invention, showing the striking position.
Figure 2:
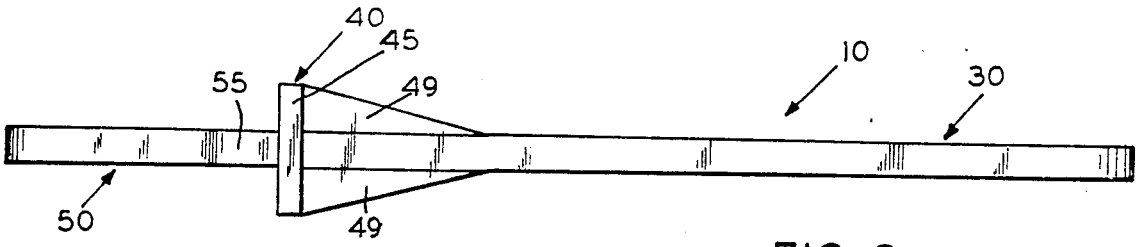
FIG. 2 is a plan view of the tool shown in FIG. 1.
Figure 3:
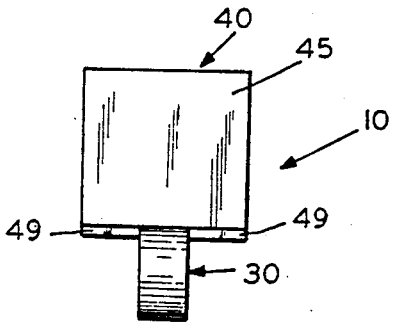
FIG. 3 is an end view of the tool shown in FIG. 1, showing the front face of the strike plate.

Referring now to the drawings, an embodiment to be preferred of an impact tool 10, made according to the present invention, is disclosed. Impact tool 10 includes, generally, an elongated shank 30; a first impact member 20; a second impact member 40; and a handle 50.

While the tool may be of any suitable dimensions, in the preferred embodiment the shank 30 is approximately twenty inches in length, having a width and height of one inch. The shank is preferably of I-beam construction and is constructed of tool steel, or other suitable material.

At a first end of the shank, also called the catch end, is a first impact member 20. Member 20 is affixed to the shank as by bolts, welding, or otherwise, or may be unitary with the shank and other structural members. Like the shank, both impact members may be constructed of tool steel. The first impact member is affixed to the shank to define a substantially planar impact face plate 25, offset from and substantially perpendicular to the longitudinal axis of the shank. The width of the first impact member is preferably no greater than the width of the shank so that the first impact member may be inserted into generally otherwise inaccessible areas. In the embodiment shown, face plate 25 is one inch square, but can be made larger or smaller, as the demand may be. It will be noted that the fact plate 25 faces a second end of the shank and therefore may be pulled into contact with the object to be contacted to "catch" the object.

On the opposing, second end of shank 30, also known as the strike end, is a second impact member 40 which may be affixed to the shank by the same means as the first impact member. The second impact member 40 defines a substantially planar impact face plate 45 which is substantially perpendicularly offset from the shank in an opposing direction from the first impact face plate. The second impact face plate, also known as the strike plate, faces the first end of shank 30 so that face plates 25 and 45 face each other, though being on opposite lateral sides of the shank. Face plate 45 preferably has a surface area at least four times the area of face plate 25. The differing surface areas of the face plates result in a greater force per surface area on the catch plate. For example, if a force of 250 pounds per square inch is delivered by hammer 3 over a strike plate having a surface area of four square inches, this impact will result in a force of 1,000 pounds per square inch on a catch plate having a surface area of one square inch.

Extending rearward from shank 30 and in parallel orientation with the shank is an elongated handle 50. While the handle is not necessary to the invention, in that shank 30 itself may serve as a handle, handle 50 is convenient in being out of the way of the swing of hammer 3. Further, the handle may be provided with a strike plate abutment member 55 which serves as reinforcement backing for the strike plate. For additional reinforcement and to help guide the hammer in its impact, the strike plate 40 may be provided with wing flanges 49, extending between the outer edges of the strike plate and the shank.

For use, the catch end of the tool may be placed into any confined space, otherwise inaccessible to the swing of the hammer, with face plate 25 of the tool engaging the object to be loosened, moved, removed, or otherwise impacted. While holding the device by means of handle 50, one or more blows are then delivered, as by means of hammer 3, on the face plate 45 of second impact member 40. The force initiated by the hammer is then transmitted by shank 30 to face plate 25 of first impact member 20 to impact the object, the direction of the applied force being in the same direction as the force of the hammer blow.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A hand held impact tool comprising:

an elongated shank having a first end and a second end;

a first impact member affixed to the first end of said shank, said first impact member provided with a substantially planar impact face offset substantially perpendicular in only one direction to the longitudinal axis of said shank and facing the second end of said shank; and a second impact member affixed to the second end of said shank said second impact member provided with a substantially planar impact face offset substantially perpendicular to the longitudinal axis of said shank in an opposing lateral direction from said face of said first impact member and facing the first end of said shank so that an impact on one of said faces by a hand swung hammer pulls the opposing impact face in the same direction as the face impacted.

2. The tool as described in claim 1 further comprising a handle affixed to one of the ends of said shank.

3. The tool as described in claim 2 wherein said handle is elongated and substantially parallel with said shank.

4. The tool as described in claim 1 wherein the surface area of the impact face of said second impact member is larger than the surface area of the impact face of said first impact member so that said second impact face is a strike face and said first impact face is a catch face.

5. The tool as described in claim, 4 wherein the surface area of the impact face of said second impact member is at least four times the surface area of the impact face of said first impact member.

6. The tool as described in claim 1 wherein the width of said first impact member is equal to or less than the width of said shank for insertion of said first impact member into confined areas.

7. The tool as described in claim 1 wherein said impact members are unitary with said shank.

* * * * *